US005747927A

United States Patent [19]

Namikawa et al.

[11] Patent Number: 5,747,927

[45] Date of Patent: May 5, 1998

[54] DISPLAY DEVICE

[75] Inventors: Mamoru Namikawa; Satoshi Yoshimura; Kenichi Honda, all of Mobara, Japan

[73] Assignee: Futaba Denshi Kogyo K.K., Mobara, Japan

[21] Appl. No.: 612,681

[22] Filed: Mar. 8, 1996

[30] Foreign Application Priority Data

Mar. 9, 1995 [JP] Japan ..... 7-077105

[51] Int. Cl.[6] ..... H01J 1/62; H01J 63/04; H01J 1/88; H01J 19/42

[52] U.S. Cl. ..... 313/495; 313/292; 313/422

[58] Field of Search ..... 313/238, 241, 313/244, 248, 250, 252–55, 257–59, 266, 268, 274, 276, 281–82, 284–86, 288, 290, 292, 309, 336, 346 R, 351, 422, 495–497; 445/50, 51

[56] References Cited

U.S. PATENT DOCUMENTS 5,329,207 7/1994 Cathey et al. ..... 313/309 X
5,463,276 10/1995 Kawasaki et al. ..... 313/496
5,532,548 7/1996 Spindt et al. ..... 313/258 X
5,576,596 11/1996 Curtin ..... 313/268
5,589,731 12/1996 Fahlen et al. ..... 313/268 X
5,600,203 2/1997 Namikawa et al. ..... 313/292 X

*Primary Examiner*—Sandra L. O'Shea
*Assistant Examiner*—Mack Haynes
*Attorney, Agent, or Firm*—Oblon, Spivak, McClelland, Maier & Neustadt, P.C.

[57] ABSTRACT

A display device capable of simplifying connection between a drive circuit and lead-out wirings led out of electrodes and being small-sized while keeping a size of an image plane from being reduced. A part of supports for holding an anode substrate and a cathode substrate spaced from each other at a predetermined interval is formed so to be conductive and is interposedly arranged between the anode electrode and a lead-out wiring formed on the cathode substrate, to thereby provide an anode lead-out wiring on the cathode substrate. Such construction permits the anode lead-out electrode to be arranged so as to extend in the same direction as a cathode lead-out electrode or a gate lead-out electrode, to thereby facilitate connection of the wirings. Also, the anode substrate can be decreased in size because a region for the anode lead-out wiring is eliminated.

7 Claims, 10 Drawing Sheets

DISPLAY DEVICE

BACKGROUND OF THE INVENTION

This invention relates to a display device including a cathode substrate, an anode substrate and supports arranged between both substrates so as to space the cathode and anode substrates from each other at a predetermined interval, and more particularly to a display device including cold cathodes of a microsize.

In recent years, vacuum microelectronics for integrating vacuum microstructures of a size as small as microns having cold cathodes of a microsize incorporated therein on a substrate for a semiconductor or the like by means of fine processing techniques for a semiconductor have come to notice in the art. For example, it has been considered to apply the vacuum microelectronics to a display device, to thereby develop a super-thin type flat panel display wherein a plurality of cold cathodes of a microsize are arranged in correspondence to every picture cell while ensuring increased luminance and eliminating flickering.

The most important component in the vacuum microelectronics is a cold cathode of a microsize which functions to emit electron to a vacuum atmosphere. Thus, various kinds of elements such as a field emission cathode, an MIM type electron emission element, a surface conduction type electron emission element, a PN junction type electron emission element and the like have been proposed for such a microsize cold cathode.

When an electric field of about $10^9$ (V/m) is applied to a surface of a metal material or that of a semiconductor material, a tunnel effect permits electrons to pass through a barrier, resulting in the electrons being discharged to a vacuum atmosphere even at a normal temperature. Such a phenomenon is referred to as a "field emission" phenomenon and a cold cathode constructed so as to emit electrons based on such a principle is referred to as "field emission cathode".

The MIM type electron emission element is constructed into a structure having a metal layer, a thin insulating layer and a thin metal layer laminated on each other, wherein application of a voltage between both metal layers causes electrons to be emitted from a side of the thin metal layer.

The surface conduction type electron emission element is so constructed that a thin film of high resistance is formed on a portion of an insulating substrate between a first electrode and a second electrode each arranged on the insulating substrate. Application of a voltage between both electrodes causes electrons to be emitted from the high-resistance thin film.

The PN junction type electron emission element is constructed so as to utilize avalanche breakdown. Alternatively, it is constructed so as to apply a forward voltage to PN junction to cause electrons injected into a P layer to be emitted from a surface of the P layer.

Of the techniques described above, the field emission cathode is the most typical. Now, a conventional field emission cathode will be described hereinafter with reference to a Spindt type field emission cathode shown in FIG. 8 by way of example. The conventional field emission cathode, as shown in FIG. 8, includes a cathode substrate 1 made of glass or the like, which is provided thereon with cathode electrodes 2, which are made of metal such as Al or the like. The cathode electrodes 2 each are formed thereon with emitters 5 of a conical shape, which are made of metal such as Mo or the like. The cathode electrode 2 is formed on a portion thereof on which the emitters 5 are not formed with an insulating layer 3, which is made of silicon dioxide ($SiO_2$). The insulating layer 3 is formed thereon with a gate electrode 4. The gate electrode 4 and insulating layer 3 are formed with through-holes 6 in a manner to be common to both. The conical emitters 5 each are arranged in each of the through-holes 6 in such a manner that a distal end thereof is exposed via the through-hole 6.

The conical emitters 5 may be arranged at pitches as small as 10 microns or less, so that tens of thousands to hundreds of thousands of emitters 5 may be provided on a single substrate. Also, the prior art permits a distance between the gate electrode 4 and the distal end of each of the emitters 5 to be reduced to a level as small as less than a micron, so that electrons may be field-emitted from the emitters 5 by merely applying a voltage as small as tens of volts between the gate electrode 4 and the emitters 5. Arrangement of an anode electrode 7 having a positive voltage $V_A$ applied thereto in a manner to be spaced from the gate electrode 4 and opposite thereto permits the anode electrode to capture the electrons thus emitted from the emitters 5. In this instance, arrangement of a phosphor on the anode electrode 7 leads to luminescence of the phosphor corresponding to a portion of the anode electrode 7 capturing the electrons. Thus, such a principle as described above permits a display device having the field emission cathodes incorporated therein to be provided. Such a display device is generally referred to as "field emission display" (hereinafter also referred to as "FED").

A conventional monochrome FED utilizing the above-described principle is typically constructed in such a manner as shown in FIG. 9. In FIG. 9, reference numeral 1 designates a cathode substrate, 2 is cathode electrodes arranged in a stripe-like manner on the cathode substrate 1, 3 is an insulating layer made of a silicon dioxide film or the like and arranged on the cathode substrate 1 and cathode electrodes 2, 4 is gate electrodes arranged in a stripe-like manner on the insulating layer 3 so as to extend in a direction perpendicular to the cathode electrodes 2, 6 is through-holes formed via both insulating layer 3 and gate electrode 4 at each of intersections between each of the cathode electrodes 2 and each of the gate electrodes 4. The cathode electrode 2 is formed thereon with emitters of a conical shape, each of which is arranged in each of the through-holes 6. 7 is an anode electrode having a phosphor deposited thereon and 8 is an anode substrate made of transparent glass or the like which is provided thereon with the anode electrode 7. Reference character A indicates an anode lead-out wiring through which an anode voltage $V_A$ is applied from a drive circuit (not shown) to the anode electrode 7. C1 to Cn each are a cathode lead-out wiring, through which a drive signal is fed from a drive circuit (not shown) to each of the cathode electrodes 2. G1 to Gm each are a gate lead-out wiring arranged so as to feed an image signal from a drive circuit (not shown) to each of the gate electrodes 4 therethrough.

In the conventional monochrome FED thus constructed, the cathode electrodes 2 are scanned through the cathode lead-out wirings C1 to Cn in order and concurrently the gate electrodes 4 are fed with an image signal through the gate lead-out wirings G1 to Gm while keeping an anode voltage $V_A$ applied to the anode electrode 7 through the anode lead-out wiring A, so that electrons may be emitted from the emitters of a conical shape arranged in the through-holes 6. The electrons are then impinged on the phosphor arranged on the anode electrode 7, resulting in display being carried out due to luminescence of the phosphor.

FIG. 10 is a plan view of the monochrome FED thus constructed. In FIG. 9, reference numeral 9 is a sealing member made of glass or the like (hereinafter also referred to as "seal glass"), which is arranged between the cathode substrate 1 and the anode substrate 8 for holding both substrates 1 and 8 spaced from each other at a predetermined interval and cooperating with both substrates to form an airtightly sealed envelope, which is then evacuated to a high vacuum. 10 is a predetermined number of supports made of an insulating material (hereinafter also referred to as "insulating supports") and arranged at predetermined intervals between the cathode substrate 1 and the anode substrate 8 to hold both substrates 1 and 8 spaced from each other at a predetermined interval against an atmospheric pressure applied thereto. C generally indicates the cathode lead-out wirings C1 to Cn shown in FIG. 9 and G generally indicates the gate lead-out electrodes G1 to Gm shown in FIG. 9.

In the monochrome FED thus constructed, an image is displayed in a region inside the seal glass 9 in which the anode electrode 7 is arranged. However, as shown in FIG. 10, the cathode substrate 1 and anode substrate 8 each are arranged so as to extend to a region outside the seal glass 9 as well. More particularly, the cathode substrate 1 has a region arranged outside the seal glass 9 on which the cathode lead-out wirings C extending from the cathode electrodes 2 are arranged and a region likewise arranged outside the seal glass 9 on which the gate lead-out electrodes led out of the gate electrodes G are arranged. Also, the anode substrate 8 have a region arranged outside the seal glass 9 on which the anode lead-out wiring A led out of the anode electrode 7 is arranged. The lead-out wirings A, C and G are arranged so as to extend in directions different from each other.

Such arrangement of the lead-out wirings A, C and G in different direction is for the reason that the cathode substrate 1 and anode substrate 8 are arranged opposite to each other at an interval as small as about 200 microns, resulting in failing to permit connection between the anode lead-out wiring A and the drive circuit (not shown) on the anode substrate 8 and connection between the cathode lead-out wirings C or gate lead-out wirings G and the drive circuit (not shown) on the cathode substrate 1 to be executed at the same position.

Also, a three-primary-color FED adapted to display an image of three primary colors or red, green and blue colors has been conventionally known in the art, which is obtained by expandedly modifying such a monochrome FED as described above. The three-primary-color FED is generally constructed in such a manner as shown in FIG. 11, wherein reference characters like those in FIG. 9 designate corresponding parts. More particularly, anode electrodes 7 provided on an anode substrate 8 are arranged in a stripe-like manner unlike in the monochrome FED of FIG. 9. The anode electrode stripes 7 are provided thereon with phosphors of red, green and blue luminous colors R, G and B in turn, respectively, and are connected to anode lead-out wirings A1 to A3 in correspondence to the luminous colors of the phosphors, respectively. In FIG. 11, the anode stripes B or the anode electrode stripes provided thereon with the phosphors of a red luminous color R are connected to the anode lead-out wiring A1 in common, the anode electrode stripes G are connected together to the anode lead-out wiring A2, and the anode electrode stripes B are connected together to the anode lead-out wiring A3. Each one anode electrode stripes R, G and B corresponding to each other are driven in one set. For this purpose, the gate electrode stripes 4 each are arranged so as to positionally correspond to each one set of anode electrode stripes R, G and B.

Now, the manner of operation of the three-primary-color FED thus constructed will be described hereinafter. First, an anode voltage is fed through the anode lead-out wiring A1 to the anode electrode stripes R of a red luminous color, during which the cathode lead-out electrode C1 is selected to feed an image signal of a red luminous color through the gate lead-out wirings G1 to Gm to the gate electrode stripes 4, so that an image of a red luminous color may be displayed by one line of the cathode electrode stripes corresponding to the cathode lead-out wiring C1. Then, the cathode lead-out wiring C2 is selected and an image signal of a red luminous color is fed to the gate electrode stripes 4. Likewise, the cathode lead-out wirings C3 to Cn are scanned in turn, resulting in the display device displaying an image of a red luminous color. Then, an anode voltage is applied through the anode lead-out wiring A2 to the anode electrode stripes G of a green luminous color and the cathode lead-out wirings C1 to Cn are selected in turn, during which data on a green luminous color are fed through the gate lead-out wirings G1 to Gm to the gate electrode stripes 4. This results in an image of a green luminous color being displayed. Subsequently, an anode voltage is applied through the anode lead-out wiring A3 to the anode electrode stripes B of a red luminous color and likewise the cathode lead-out wirings C1 to Cn are scanned in order, during which data on a green luminous color are fed through the gate lead-out wirings G1 to Gm to the gate electrode stripes 4, so that an image of a blue luminous color may be displayed. Such operation is repeated, to thereby the display device to display a three-primary-color image.

The anode substrate 8 of the color FED is generally constructed as shown in FIG. 12. More specifically, the anode substrate 8 is provided on a central region thereof with the stripe-like anode electrodes having the phosphors of red, green and blue luminous colors R, G and B deposited thereon, respectively, wherein the anode electrode stripes R of a red luminous color are connected to the anode lead-out wiring A1 in common, the anode electrode stripes G of a green luminous color are connected together to the anode lead-out wiring A2, and the anode electrode stripes B of a blur luminous color are connected together to the anode lead-out wiring A3. Thus, connection of the three kinds of anode electrodes stripes R, G and B to the corresponding anode lead-out wirings A1 to A3 on the anode substrate 8 requires intersection between a conductive wiring for connecting any one of the three kinds of anode electrode stripes to the corresponding anode lead-out wiring and the anode lead-out wirings of the remaining anode electrode stripes. In FIG. 12, a conductive wiring for connecting the anode electrode stripes B to the anode lead-out wiring A3 is arranged so as to intersect the anode lead-out wiring A2. Such intersection may be carried out by forming the insulating layer on the anode lead-out wiring A2 and then forming, on the insulating layer, the conductive wiring for connection between the anode electrode stripes B and the anode lead-out wiring A3. Alternatively, it may be carried out using three-dimensional wiring techniques of connecting the anode electrode stripes B and anode lead-out wiring A3 to each other by means of a conductive film.

In each of the conventional monochrome and color display devices described above, as shown in FIG. 10, the region on which the cathode lead-out wirings C are provided, that on which the anode lead-out wiring A is provided and that on which the gate lead-out wirings G are provided are arranged on different sides of the display device. Unfortunately, this requires to carry out connection between the driving circuits and the lead-out wirings on three sides of the display device, resulting in requiring to repeat operation for the connection three times. Also, in the prior art, in order to provide a region required for forming the anode lead-out wiring A, it is required to extend the anode substrate 8 in one direction beyond the seal glass 9 as shown in FIG. 10. The extended region of the anode substrate 8 does not contribute to display of an image, so that the display device is caused to be large-sized while keeping an area of a image plane from being increased.

Also, in the conventional color display device, as described above, it is required to construct the conductive wiring for connection between the anode electrode stripes and the anode lead-out wirings into a three-dimensional structure. Such a three-dimensional wiring structure, as described above, renders manufacturing of the display device highly complicated. Also, it requires to increase an anode voltage to a relatively high level, to thereby cause concentration of an electric field, resulting in dielectric breakdown readily occurring.

The present invention has been made in view of the foregoing disadvantages of the prior art.

SUMMARY OF THE INVENTION

Accordingly, it is an object of the present invention to provide a display device which is capable of facilitating connection between the display device and drive circuits.

It is another object of the present invention to provide a display device which is capable of decreasing an overall size of the display for an area of an image plane.

It is a further object of the present invention to provide a color display device which is capable of facilitating the manufacturing.

It is still another object of the present invention to provide a color display device which is capable of eliminating a necessity of arranging a three-dimensional wiring structure on an anode substrate.

In accordance with the present invention, a display device is provided. The display device includes an anode substrate provided thereon with at least one phosphor-deposited anode electrode, a cathode substrate provided thereon with at least cold cathodes of a microsize, a seal member arranged between the anode substrate and the cathode substrate so as to space the anode substrate and cathode substrate from each other at a predetermined interval in a manner to be opposite to each other and form sealing between the anode substrate and the cathode substrate to a degree sufficient to form an envelope which is evacuated to a high vacuum, and a plurality of supports arranged between the anode substrate and the cathode substrates so as hold the anode substrate and cathode substrate spaced from each other at a predetermined interval. A part of a plurality of the supports is formed to be conductive so as to act as conductive supports.

In a preferred embodiment of the present invention, the cathode substrate is provided thereon with at least one conductive wiring and the conductive supports are arranged so as to be abutted against the conductive wiring and anode substrate.

In a preferred embodiment of the present invention, the conductive wiring is outwardly led out through the sealing member to feed the anode electrode with a drive voltage through the conductive wiring.

In a preferred embodiment of the present invention, the conductive wiring is arranged so as to extend in a direction identical with conductive wirings led out of the cold cathodes.

In a preferred embodiment of the present invention, a plurality of the anode electrodes are arranged in a stripe-like manner and have phosphors arranged thereon so as to emit light of red, blue and green luminous colors for every stripes, wherein the stripe-like anode electrodes are connected to corresponding lead-out wirings depending on the luminous colors and the lead-out wirings corresponding to the luminous colors are connected to the conductive wirings formed on the cathode substrate through the conductive supports without intersecting each other on the anode substrate.

In a preferred embodiment of the present invention, the cold cathodes of a microsize each comprise a field emission cathode.

In a preferred embodiment of the present invention, the cold cathodes of a microsize each comprise one selected from the group consisting of an MIM type electron emission element, a surface-conductive type electron emission element and a PN conjunction type electron emission element.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, a display device according to the present invention will be described hereinafter with reference to the accompanying drawings.

Figure 1:
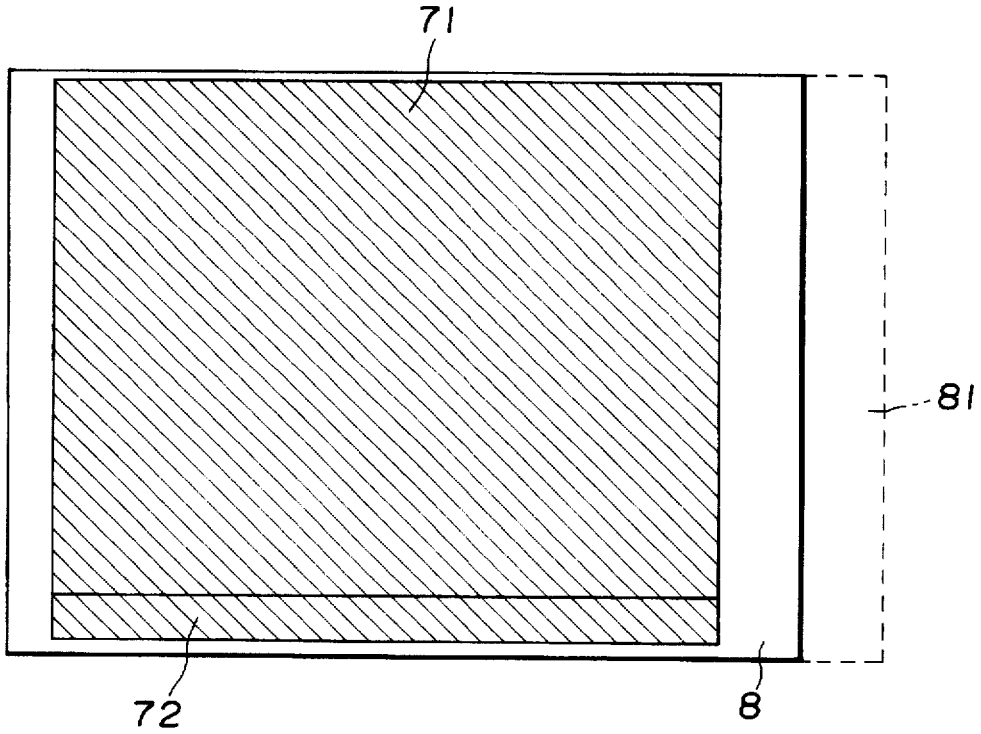
FIG. 1 is a schematic view showing an anode substrate incorporated in an embodiment of a display device according to the present invention which is applied to a monochrome FED.

Referring first to FIGS. 1 to 4, an embodiment of a display device according to the present invention is illustrated, which is applied to a monochrome FED. A display device of the illustrated embodiment includes an anode substrate 8 constructed in such a manner as shown in FIG. 1. The anode substrate 8, as shown in FIG. 1, is so formed that one side of the anode substrate 8 or a right-hand side of the anode substrate 8 in FIG. 1 is contracted as compared with an anode substrate 81 incorporated in the prior art which is indicated at dotted lines in FIG. 1. Also, the anode substrate 8 is formed thereon with an anode electrode region indicated at oblique lines, which includes an anode electrode region 71 defined in the prior art, as well as a region 72 expanded by the illustrated embodiment. Thus, an area of the anode electrode in the illustrated embodiment is increased in an amount indicated at reference numeral 72 as compared with the conventional anode electrode 71.

Figure 2:
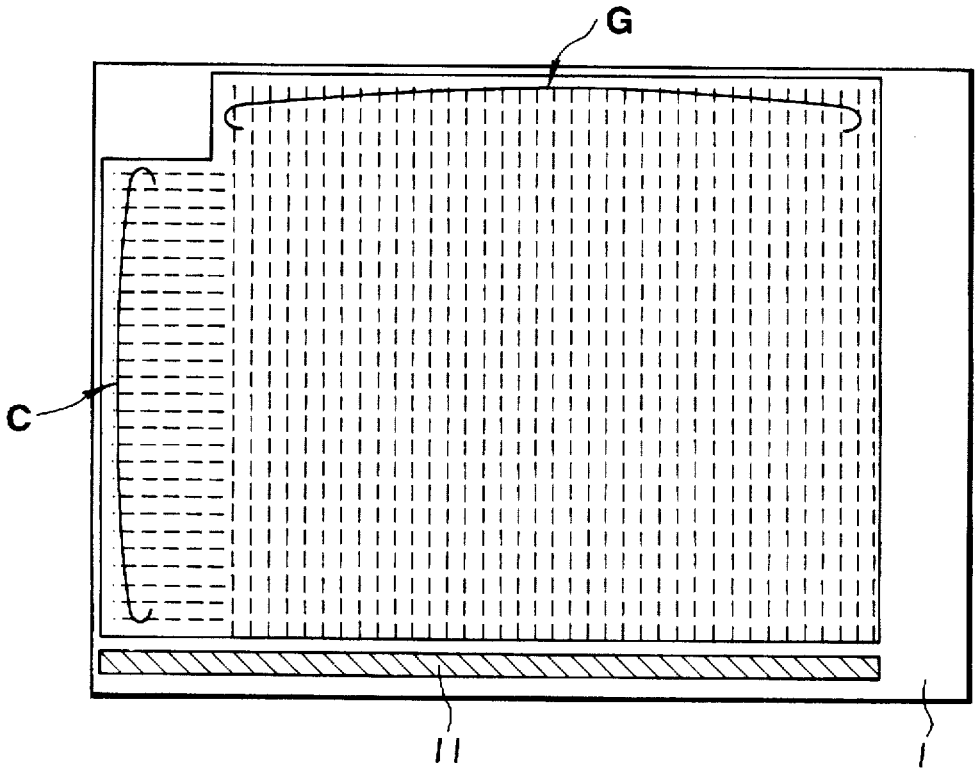
FIG. 2 is a schematic view showing a cathode substrate incorporated in an embodiment of a display device according to the present invention which is applied to a monochrome FED.

The display device of the illustrated embodiment also includes a cathode substrate 1 constructed as shown in FIG. 2. The cathode substrate 1 in the illustrated embodiment is formed into the same size as a cathode substrate in the prior art. In FIG. 2, a region indicated by dotted lines is provided thereon with cathode electrodes, an insulating layer and gate electrodes. In FIG. 2, reference character C designates cathode lead-out wirings and D is gate lead-out wirings. Reference numeral 11 is a conductive wiring formed on a lower margin of the cathode substrate 1, which conductive wiring 11 is provided by the illustrated embodiment. The conductive wiring 11 is adapted to be located below the extended anode electrode region 72 when the cathode substrate 1 and anode substrate 8 are superposed on each other. The conductive wiring 11 is desirably formed simultaneously with formation of the gate electrodes.

Figure 3:
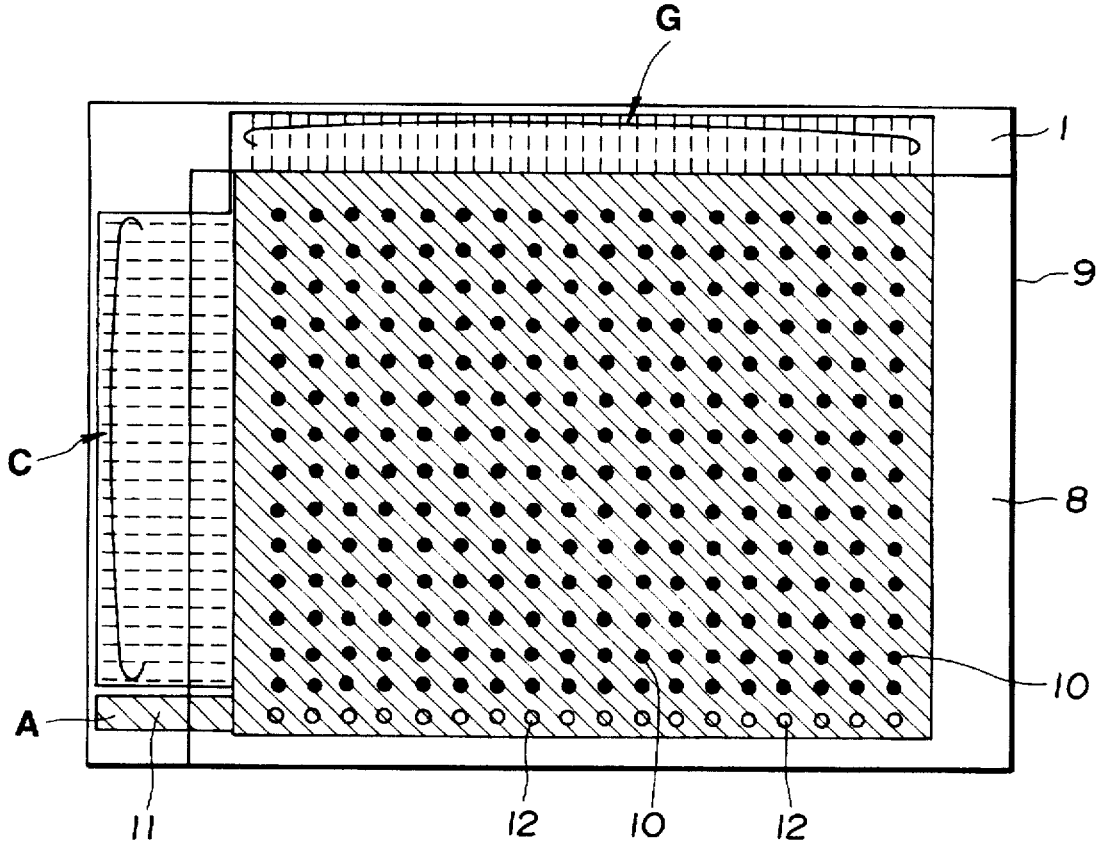
FIG. 3 is a schematic plan view showing an embodiment of a display device according to the present invention which is applied to a monochrome FED.

The anode substrate 8 shown in FIG. 1 and the cathode substrate 1 shown in FIG. 2 are superposed on each other to provide the monochrome FED of the illustrated embodiment, which is shown in FIG. 3, wherein reference numeral 1 is the cathode substrate, 8 is the anode substrate and 9 is seal glass. Black spots indicated at reference numeral 10 each are an insulating support for holding the anode substrate 8 and cathode substrate 1 spaced from each other at a predetermined interval against an atmospheric pressure applied thereto. For this purpose, a predetermined number of such supports 10 are arranged at predetermined intervals between the cathode substrate 1 and the anode substrate 8. White spots indicated at reference numeral 12 each designate a conductive support, which is arranged between the extended anode electrode region 72 and the conductive wiring 11 formed on the cathode substrate 1 to hold the both substrates 1 and 8 spaced from each other at a predetermined interval against an atmospheric pressure applied thereto like the supports 10, as well as to electrically connect the conductive wiring 11 and anode electrode to each other therethrough. The illustrated embodiment thus constructed permits a drive signal to be fed to the anode electrode through the conductive wiring 11 formed on the cathode substrate 1. Thus, it will be noted that the conductive wiring 11 constitutes an anode lead-out wiring A. In the illustrated embodiment, the conductive supports 12 each may be formed of a glass cylindrical member of about 50 microns in diameter and about 200 microns in height which has a film of metal such as gold, silver, copper, indium, nickel or the like deposited or plated thereon.

Figure 4:
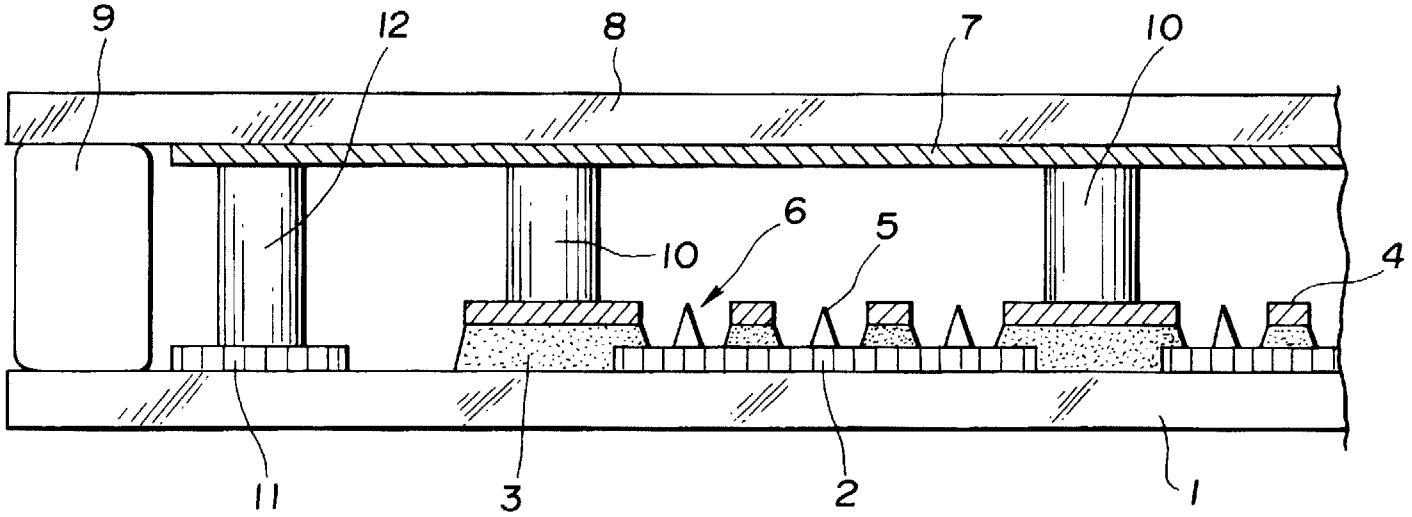
FIG. 4 is a fragmentary vertical sectional view showing an essential part of the display device of FIG. 3.

Now, the monochrome FED of the illustrated embodiment will be more detailedly described hereinafter with reference to FIG. 4.

The cathode substrate 1 is formed thereon with a stripe-like cathode electrodes 2. The cathode substrate 1 and/or cathode electrodes 2 are formed thereon with an insulating layer 3 made of $SiO_2$. The insulating layer 3 is formed thereon with gate electrodes 4 in a stripe-like manner. The cathode electrodes 2 each are provided thereon with a plurality of emitters 5 of a conical shape. The insulating layer 3 and gate electrodes 4 are formed with a plurality of through-holes 6 in a manner to be common to both, in each of which each of the conical emitters 5 is arranged. The anode substrate 8 is made of a transparent glass material and has an anode electrode 7 arranged thereon. The seal glass 9 is arranged between the cathode substrate 1 and the anode substrate 8 so as to space both substrates 1 and 8 from each other at a predetermined distance and seal a space between both substrates, resulting in cooperating with both substrates 1 and 8 to provide an airtightly sealed envelope, which is then evacuated to a high vacuum. The supports 10 each are made of an insulating material. The insulating supports 10 are abutted at an upper end thereof against the anode electrode 7 and at a lower end thereof against the insulating layer 3 or gate electrodes 4. The conductive wiring 11, as described above, is arranged on the lower margin of the cathode substrate 1. The conductive supports 12 are arranged between the conductive wiring 11 and the anode electrode 7 to hold the cathode substrate 1 and anode substrate 8 spaced from each other at a predetermined interval against an atmospheric pressure and electrically connect the anode electrode 7 and conductive wiring 11 to each other therethrough. The number of conductive supports 12 may be one. However, a decrease in the number of conductive supports 12 tends to cause concentration of an electric field, leading to dielectric breakdown, thus, a plurality of such conductive supports 12 are desirably arranged at predetermined intervals on the conductive wiring 11.

In the monochrome FED thus constructed, an anode voltage applied from a drive circuit (not shown) to the conductive wiring 11 formed on the cathode substrate 11 so as to function as the anode lead-out wiring A is then applied through the conductive supports 12 to the anode electrode 7. Such construction permits the anode lead-out wiring A to be formed on the cathode substrate, so that it may be arranged on the same side as the cathode lead-out wirings C or gate lead-out wirings G.

Figure 5:
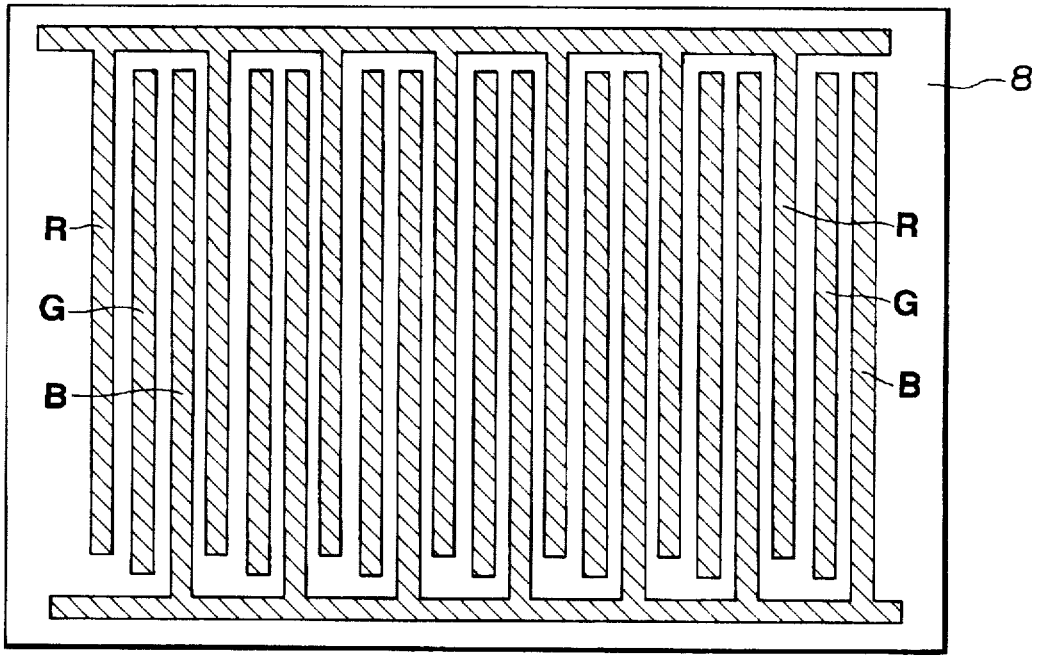
FIG. 5 is a schematic view showing an anode substrate incorporated in another embodiment of a display device according to the present invention which is applied to a three-primary-color FED.
Figure 6:
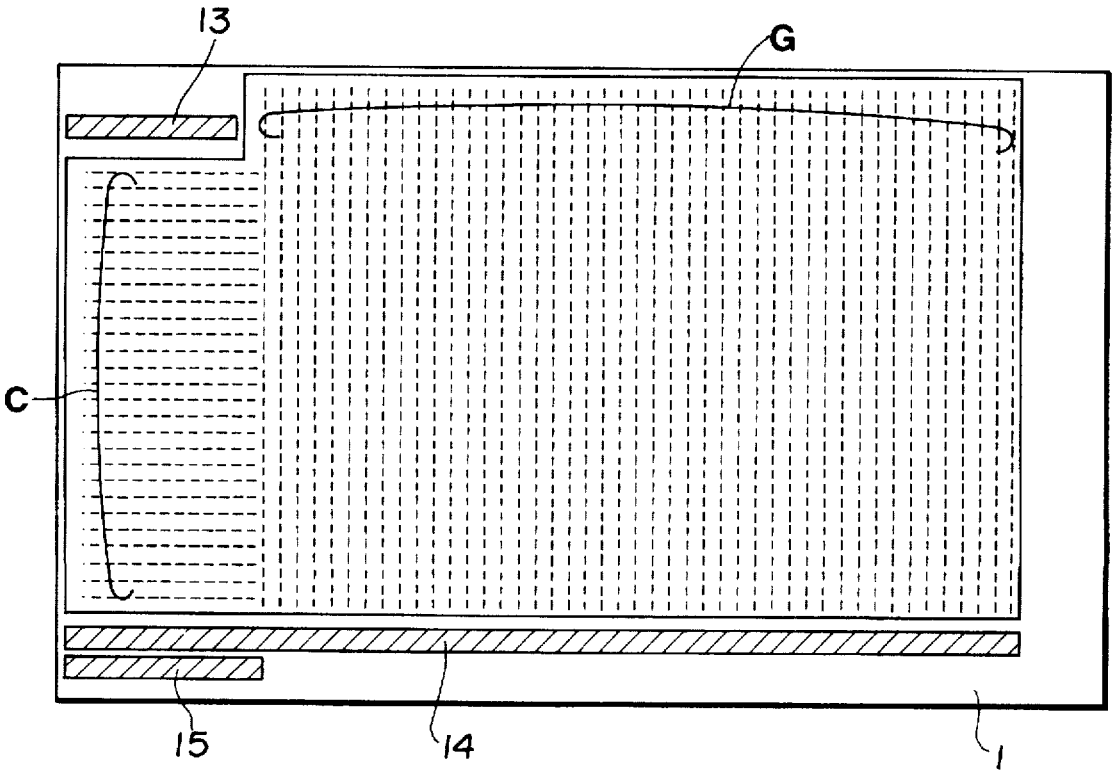
FIG. 6 is a schematic view showing a cathode substrate incorporated in another embodiment of a display device according to the present invention which is applied to a three-primary-color FED.
Figure 7:
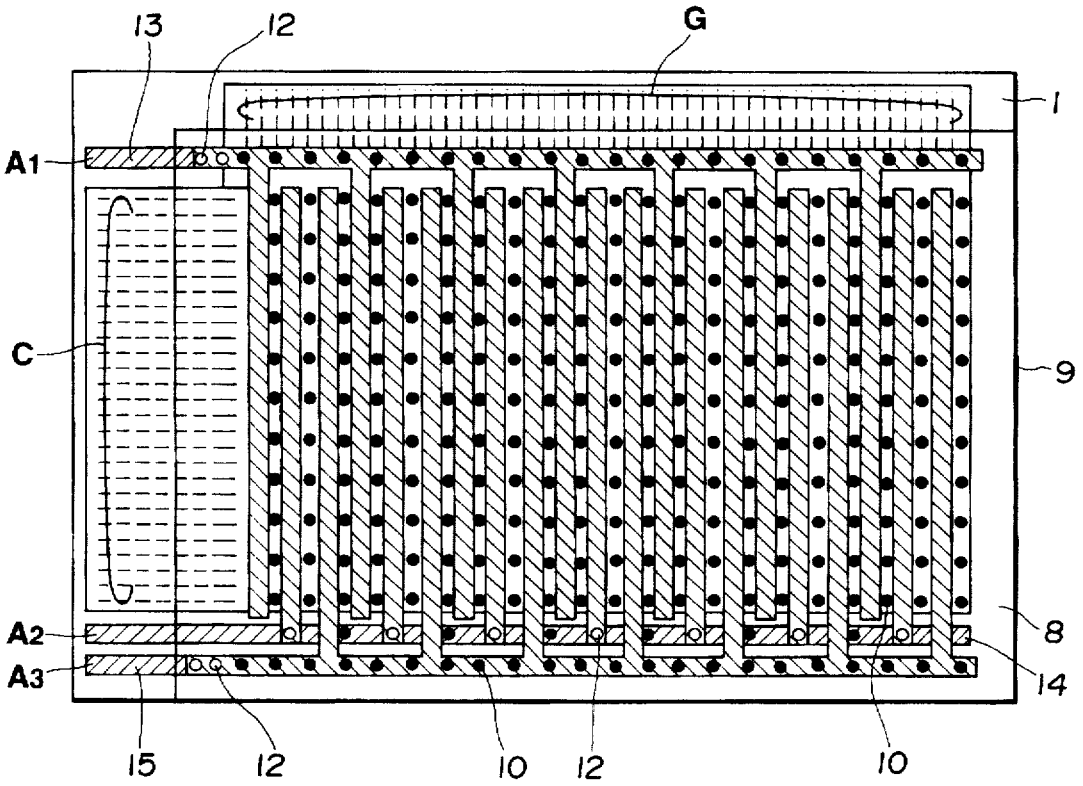
FIG. 7 is a schematic plan view showing another embodiment of a display device according to the present invention which is applied to a three-primary-color FED.
Figure 8:
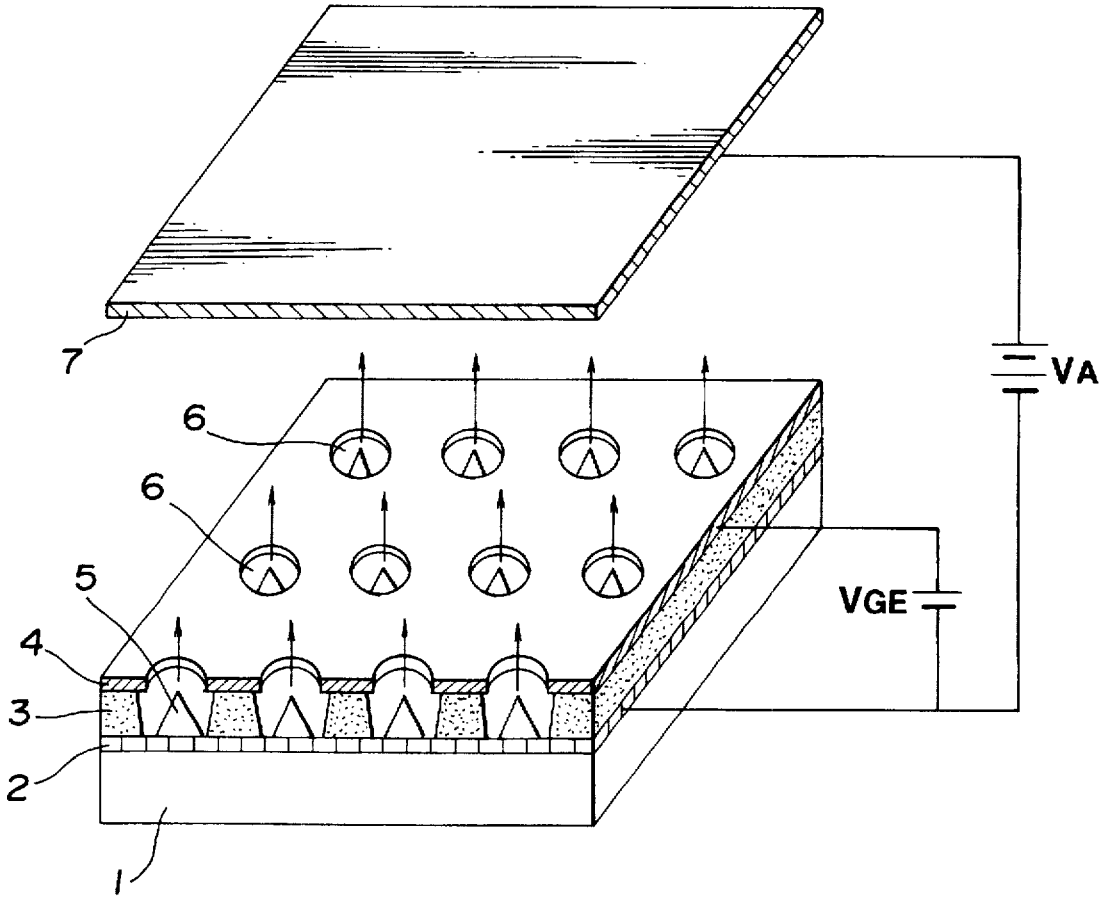
FIG.8 PRIOR ART
FIG. 8 is a schematic exploded perspective view showing a Spindt-type field emission cathode.
Figure 9:
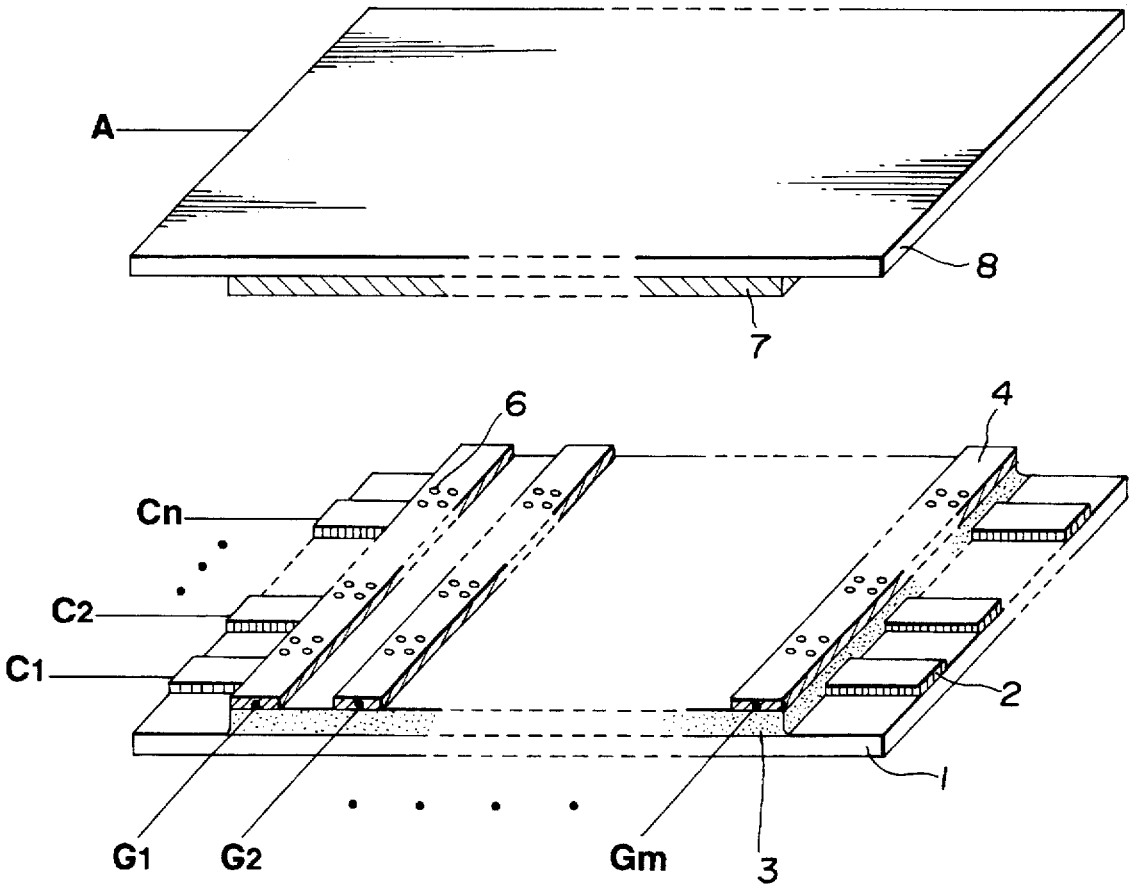
FIG.9 PRIOR ART
FIG. 9 is a schematic perspective view showing a conventional monochrome display device of the field emission type.
Figure 10:
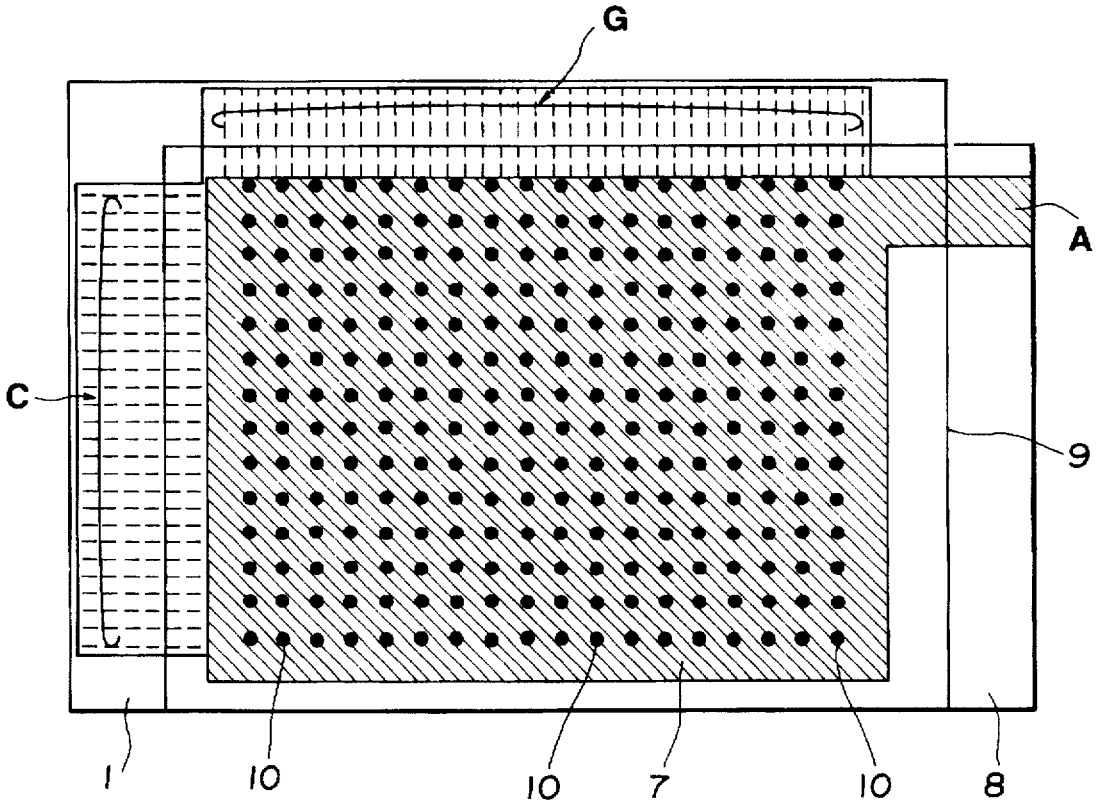
FIG.10 PRIOR ART
FIG. 10 is a plan view of the conventional monochrome display shown in FIG. 9.
Figure 11:
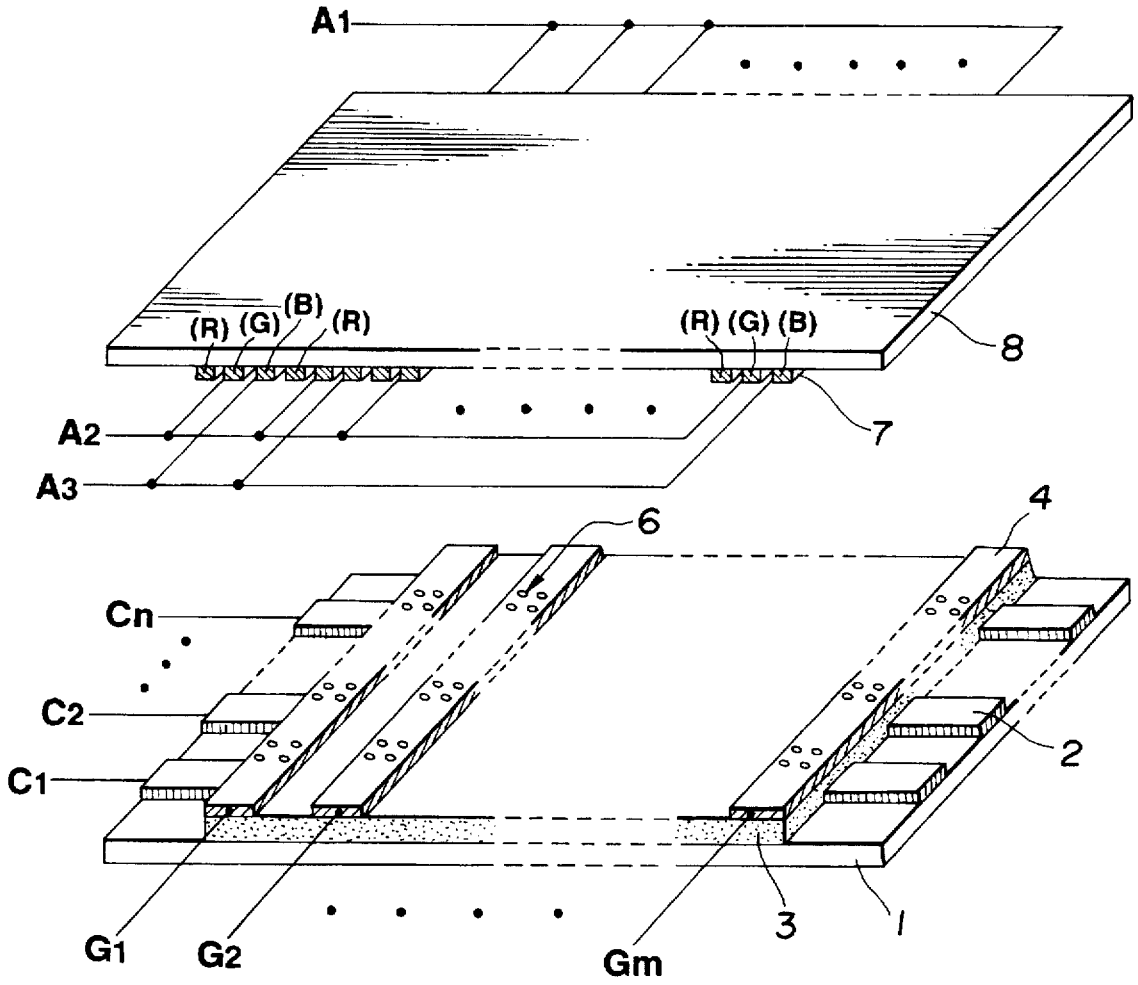
FIG.11 PRIOR ART
FIG. 11 is a schematic perspective view showing a conventional three-primary-color display device of the field emission type.
Figure 12:
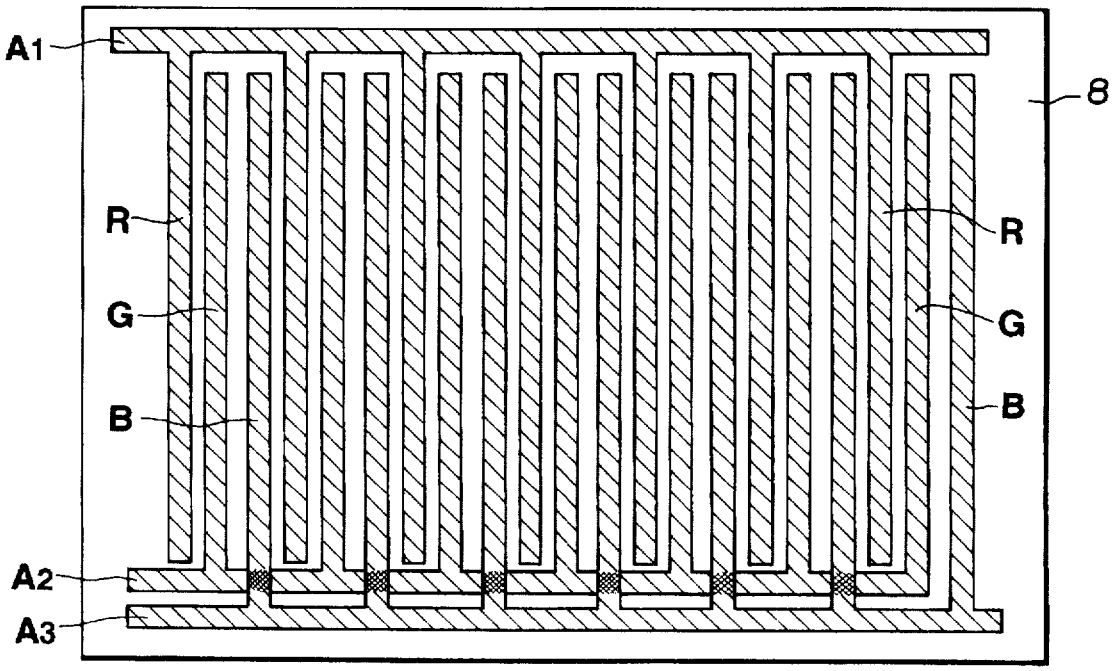
FIG.12 PRIOR ART
FIG. 12 is a plan view of the conventional monochrome display shown in FIG. 11.

Referring now to FIGS. 5 to 7, another embodiment of a display device according to the present invention is illustrated, which is applied to a three-primary-color FED adapted to display an image of three primary colors. A three-primary-color FED of the illustrated embodiment includes an anode substrate 8 constructed as shown in FIG. 5. The anode substrate 8 is provided on a central region thereof with stripe-like anodes R, G and B on which phosphors of red, green and blue luminous colors are arranged in order. The anode electrode stripes R or the anodes associated with the phosphor of a red luminous color are connected to a conductive wiring arranged on an upper portion of the anode substrate 8 in FIG. 5 and the anode electrode stripes B associated with a blue luminous color are connected to a conductive wiring arranged on a lower portion of the anode substrate 8. The anode electrode stripes G of a green luminous color are connected to neither of both conductive wirings.

The three-primary-color FED of the illustrated embodiment also includes a cathode substrate 1 constructed as shown in FIG. 6. A region indicated at dotted lines in FIG. 6 is provided thereon with cathode electrodes, an insulating layer and gate electrodes. Reference character C designates cathode lead-out wirings and G is gate lead-out wirings. Reference numerals 13 to 15 each are a conductive wiring formed on a margin of the cathode electrode 1. More particularly, the conductive wiring 13 is arranged on an upper left-side portion of the margin of the cathode substrate 1 so as to be superposed on the conductive wiring connected to the anode electrode stripes R formed on the upper portion of the anode substrate 5 shown in FIG. 5, when the anode substrate 8 and cathode substrate 1 are superposed on each other. The conductive wiring 14 is formed into substantially the same length as the cathode electrodes on a lower portion of the margin so as to be superposed on all the anode electrode stripes G and the conductive wiring 15 is arranged on a portion of the margin below the conductive wiring 14 so as to be superposed on the anode stripes B formed on the lower portion of the anode substrate 8. Formation of the conductive wirings 13 to 15 may be efficiently carried out when it is conducted simultaneously with formation of the gate wirings.

Superposition of the cathode substrate 1 of FIG. 6 and the anode substrate 1 of FIG. 5 on each other permits the three-primary-color FED of the illustrated embodiment to be provided as shown in FIG. 7. In FIG. 3, reference numeral 1 is the cathode substrate, 8 is the anode substrate and 9 is seal glass. Black spots indicated at reference numeral 10 each are an insulating support arranged between the anode substrate 8 and the cathode substrate 1 for holding the anode substrate 8 and cathode substrate 1 spaced from each other at a predetermined interval against an atmospheric pressure applied thereto. For this purpose, a predetermined number of such insulating supports 10 are arranged at predetermined intervals between the cathode substrate 1 and the anode substrate 8. White spots indicated at reference numeral 12 each designate a conductive support, which is arranged at a predetermined position between the anode substrate 8 and the cathode substrate 1 to hold both substrates 1 and 8 spaced from each other at a predetermined interval against an atmospheric pressure applied thereto like the insulating supports 10, as well as to electrically connect the conductive wiring formed on the anode substrate 8 and the conductive wirings formed on the cathode substrate 1.

In the illustrated embodiment, the conductive supports 12 are arranged at a position at which the conductive wiring formed on the upper portion of the anode substrate 8 and connected to the anode electrode stripes R and the conductive wiring 13 formed on the upper left-side portion of the margin of the cathode substrate 1 are superposed on each other. Such arrangement of the conductive supports 12 permits the conductive wiring 13 to function as an anode lead-out wiring A1 for feeding the anode electrode stripes R with a drive signal. Also, the conductive supports 12 are arranged at a position at which the anode electrode stripes G formed on the anode substrate 8 and the conductive wiring 14 formed into the substantially same length as the cathode electrodes on the lower portion of the margin of the cathode substrate 1 are superposed on each other. Such arrangement permits the conductive wiring 14 to act as an anode lead-out wiring A2 corresponding to the anode electrode stripes G. Further, the conductive supports 12 are arranged at a position at which the conductive wiring connected to the anode electrode stripes B formed on the lower portion of the anode substrate 8 and the conductive wiring 15 formed on the lower portion of the margin of the cathode substrate 1 are superposed on each other. This results in the conductive wiring 15 serving as an anode lead-out electrode A3 corresponding to the anode electrode stripes B.

Thus, the illustrated embodiment permits all the anode electrodes formed on the anode substrate 8 to be respectively connected through the conductive supports 12 to the conductive wirings formed on the cathode substrate 1 and all the anode lead-out wirings to be formed on the cathode substrate. Also, the anode electrodes can be connected to the anode lead-out wirings without arranging any three-dimensional wiring structure on the anode substrate of the three-primary-color FED.

In FIG. 7, the conductive supports for connecting the anode electrode stripes G and the corresponding lead-out wiring 14 formed on the cathode substrate to each other are arranged one for every anode electrode stripe G. However, the illustrated embodiment is not limited to such arrangement of the conductive supports. The conductive wiring 14 may be formed into an increased width, so that a plurality of such conductive supports may be arranged for every anode electrode stripe. Such arrangement effectively prevents concentration of an electric field, resulting in previously preventing dielectric breakdown.

In each of the embodiments described above, the conductive supports each are formed of a cylindrical glass member having a metal film formed thereon by deposition or plating. The conductive support is not limited to a cylindrical configuration. Also, any other suitable material other than glass may be used for this purpose. The conductive supports are merely required to connect the conductive wirings formed on the anode substrate and the conductive wirings formed on the cathode substrate to each other therethrough and exhibit rigidity sufficient to hold the anode substrate and cathode substrate spaced from each other at a predetermined interval. For example, the conductive supports each may comprise a metal wire having a diameter corresponding to the interval between both substrates, which is arranged therebetween.

Also, in each of the embodiments, the anode lead-out wiring is arranged so as to extend in the same direction as the cathode lead-out wirings. Alternatively, it may be led out in the same direction as the gate lead-out electrodes.

Further, in each of the embodiments, the display device has the field emission cathodes incorporated therein so as to function as cold cathodes of a microsize. Alternatively, the cold cathode of a microsize may comprise an MIM type electron emission element, a surface-conduction type electron emission element or a PN junction type electron emission element.

The above description has been made in connection with a field emission type display device (FED). However, the present invention may be suitably applied to other display devices such as, for example, a fluorescent display device and the like.

As can be seen from the foregoing, the display device of the present invention is so constructed that a part of the supports is rendered conductive. Such construction permits the lead-out wirings of the electrodes in the display device to be arranged on two sides. This effectively reduces a period of time required for operation of connecting the display device and drive circuit to each other and decreases an overall size of the display device. Also, it permits a three-primary-color display device to be provided which eliminates a necessity of arranging any three-dimensional wiring structure on the anode substrate.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A display device comprising:

an anode substrate provided thereon with at least one phosphor-deposited anode electrode;

a cathode substrate provided thereon with at least cold cathodes of a microsize;

a seal member arranged between said anode substrate and said cathode substrate so as to space said anode substrate and cathode substrate from each other at a predetermined interval in a manner to be opposite to each other and form sealing between said anode substrate and said cathode substrate to a degree sufficient to form an envelope which is evacuated to a high vacuum; and a plurality of supports arranged between said anode substrate and said cathode substrates so as to hold said anode substrate and cathode substrate spaced from each other at a predetermined interval;

a part of said plurality of supports being formed to be conductive so as to act as conductive supports.

2. A display device as defined in claim 1, wherein said cathode substrate is provided thereon with at least one conductive wiring;

said conductive supports being arranged so as to be abutted against said conductive wiring and anode substrate.

3. A display device as defined in claim 2, wherein said conductive wiring is outwardly led out through said sealing member to feed said anode electrode with a drive voltage through said conductive wiring.

4. A display device as defined in claim 3, wherein said conductive wiring is arranged so as to extend in a direction identical with conductive wirings led out of said cold cathodes.

5. A display device as defined in any one of claims 2 to 4, wherein a plurality of said anode electrodes are arranged in a stripe-like manner and have phosphors arranged thereon so as to emit light of red, blue and green luminous colors for every stripes;

said stripe-like anode electrodes being connected to corresponding read-out wirings depending on the luminous colors;

said lead-out wirings corresponding to the luminous colors being connected to said conductive wirings formed on said cathode substrate through said conductive supports without intersecting each other on said anode substrate.

6. A display device as defined in any one of claims 1 to 4, wherein said cold cathodes of a microsize each comprise a field emission cathode.

7. A display device as defined in any one of claims 1 to 4, wherein said cold cathodes of a microsize each comprise one selected from the group consisting of an MIM type electron emission element, a surface conduction type electron emission element and a PN conjunction type electron emission element.

* * * * *